343/700MS

United States Patent [19]

Canal

[11] Patent Number: 4,591,865

[45] Date of Patent: May 27, 1986

[54] THIN-STRUCTURE DUAL DIRECTIONAL ANTENNA FOR HIGH FREQUENCIES

[75] Inventor: Yves S. Canal, Massy, France

[73] Assignee: U.S. Philips Corporation, New York, N.Y.

[21] Appl. No.: 556,506

[22] Filed: Nov. 30, 1983

[30] Foreign Application Priority Data

Dec. 3, 1982 [FR] France ..... 82 20290

[51] Int. Cl.[4] ..... H01Q 13/10

[52] U.S. Cl. ..... 343/767; 343/700 MS; 343/785

[58] Field of Search ..... 343/785, 908, 700 MS, 343/767

[56] References Cited

U.S. PATENT DOCUMENTS

| | | | |
|---|---|---|---|
| 2,648,002 | 8/1953 | Eaton | 343/785 |
| 2,822,542 | 2/1958 | Butterfield | 343/785 |
| 3,739,391 | 6/1973 | Mauroides et al. | 343/785 |

*Primary Examiner*—Eli Lieberman

*Attorney, Agent, or Firm*—Robert J. Kraus

[57] ABSTRACT

The antenna is designed to radiate decimetric or centimetric waves according to an acute angle $\theta_o$ capable of varying by several dozens of degrees. It has the shape of a rectangular parallelepiped having a thickness e, a length L and a width $l_t$ metal-plated over almost its entire surface and containing a material having a dielectric constant $\epsilon_r$. According to the invention only a band having a fixed width d has not been metal-plated, which band extends substantially in the center over a large face of the antenna, d being equal to several times e, the second large metal-plate face constituting the ground plane. A micro-strip line (26) which crosses the band and contains the antenna feedpoint (31) electrically interconnects the two metal-plated semi-surfaces (28, 29) defined by the non-plated band. The thickness e is of the order of that of a printed circuit board, the length L ($L=N+z_a$) is more than twice the wavelength λ of the wave to be transmitted and the width $l_t$($l_t=l_1+l_2$) is between 0.2 and 0.6λ.

10 Claims, 14 Drawing Figures

THIN-STRUCTURE DUAL DIRECTIONAL ANTENNA FOR HIGH FREQUENCIES

BACKGROUND OF THE INVENTION

The invention relates to a directional antenna for high frequencies, capable of radiating decimetric or centrimetric waves in accordance with a narrow angular range whose median angle $\theta_o$ belongs substantially to the range 5°–85°. The antenna is formed by a solid of a substantially rectangular parallelepiped shape having a thickness e, a length L and a width $l_t$, and comprises a substrate material having a thickness h and a dielectric constant $\epsilon_r$, whose surface is almost entirely metal-plated. The antenna is intended to be flush-mounted on the exterior wall of a missile or an aircraft.

A specific field of application of such antennae is that of proximity fuses or missile radar equipment for transmission or reception. In this application a radiation diagram is desired in the form of a conical semi-nappe or a full conical nappe directed towards the front of the missile, with a pronounced ascending edge of the major lobe, which is inclined at an angle $\theta_o$ with respect to the axis of the missile. For this type of application the angle $\theta_o$ is in the range 20°–70° and the side lobes which have a radiation angle near 90° must have a reduced amplitude of at least 15 to 20 dB with respect to the major lobe in such a manner that particularly the radiation towards the ground is attenuated to the highest possible extent. On the other hand, an aerial mounted on the outer wall of a missile must be small and must assume as much as possible the generally curved shape of this wall so as to avoid a negative effect on the aero-dynamic properties of this wall and to ensure a good mechanical bond and a limited degree of heating in consideration of the high speed at which the missile moves through the air. A main characteristic of this type of antennae is to exhibit a wide roll diagram, whose shape, when the antenna is mounted on a cylinder, is very near to a cardioid. Moreover, because of the travelling wave, the diagram in the meridian plane is directional and orientable as a function of the operating frequency. Finally, the matching band must be on the order of 15% for a standing-wave ratio of 2 (90% of the transmitted power).

Directional antennae of the type described in the opening paragraph are disclosed more specifically in the article "Travelling-wave slot antennae" by J. H. Hines et al. published in PROCEEDINGS OF THE IRE (pages 1624–1631), volume 41, no. 11, November 1953, IEEE NEW YORK (U.S.). This article relates particularly to a slotted directional antenna for very high frequencies, filled with a dielectric material. More accurately, this prior art antenna is constituted by a groove perpendicular to the ground plane, which causes the antenna to be too wide (deep) and too thick. The excessive width (depth) makes it difficult to flush-mount the antenna to the wall of an aircraft and the excessive thickness renders it impossible to control perfectly the radiation diagram of the antenna, even when grouped in an array (especially when the dielectric is formed by the air). As a matter of fact, an excessively large thickness gives rise to losses, more specifically losses due to very high radiations, so that comparatively short antennas are ultimately chosen, while a good directional antenna of this type must still be capable of radiation at a distance from the feed point equal to several times the length of the wave in the air. It should furthermore be noted that arranging the antenna perpendicularly to the ground plane makes it impossible to obtain a wide roll diagram, particularly when the antenna is formed by an array of at least two elementary antennas.

Alternatively, thin-structure antennas are known which make use of printed circuit technology, more specifically of the type described in French Patent Application No. 2,481,526, filed by Applicants and corresponding to U.S. Pat. No. 4,371,877. This antenna has the advantages that it is of reduced bulk and that it is easy to realize, as is desired, but it is not directional. It operates as a cavity in the resonant mode, and radiates like a dipole, its diagram having the shape of a semi-torus (angle $\theta_o$ is equal to 90°), whose axis merges into the axis of the air-craft on which it has been mounted. Further known antennas such as "pavement" antennas or flat antennas, employing printed circuit techniques also operate as dipoles, preventing them from being used in the field of application desired for the present invention.

SUMMARY OF THE INVENTION

It is an object of the present invention to provide a thin-structure directional antenna of a simple construction.

A further object of the invention is to provide a thin-structure directional antenna whose roll diagram is as wide as possible.

A still further object of the invention is to provide a thin-structure directional antenna whose pitch diagram exhibits highly attenuated side lobes for a radiation angle of 90°.

A still further object of the invention is to provide a thin-structure directional antenna whose pitch diagram exhibits highly attenuated side lobes.

These objects are accomplished, and the disadvantages of the prior art are reduced or eliminated, by providing an antenna incorporating the structure defined in the opening paragraph, but in which the radiating portion of the antenna where the dielectric material as in contact with the environment is reduced to a rectilinear band of a fixed width d which extends over a first large face of the parallelepiped in the longitudinal direction. This band defines the bottom of a longitudinal slot which divides the first large face into two substantially equal metal-plated semi-surfaces. The width d of the said band is on the order of several times the thickness e. The second large metal-plated face constitutes the ground plane of the antenna, and the two large faces are interconnected in the region of the external lateral boundaries by short-circuits. A microstrip line crosses the band and electrically interconnects the said two semi-surfaces in points on their edges whose predetermined positions are situated near a first end of each of the semi-surfaces. The antenna socket is attached to a predetermined feed point of the micro-strip line. The thickness e is on the order of that of a printed circuit, there being such a ratio between the length L and the thickness e that the energy reflected at the second end remote from each of the semi-surfaces can substantially be disregarded, and being in any case higher than twice the wavelength $\lambda$ of the wave to be transmitted. The width $l_t$, which is the sum of the respective widths $l_1$, $l_2$ of the semi-surfaces, and the dimension d is between $0.2\lambda$ and $0.6\lambda$.

The basic principle of the invention is to provide in the first place an elementary directional antenna with continuous slots in the form of a parallelepiped comprising between its two large metal-plated faces, a thin layer of dielectric material, and at least a short circuit which extends across an intermediate face. The other intermediate face formed by the dielectric constitutes a radiation slot, and one of the metal-plated large faces which extends beyond the slot forms the ground plane. Two of these antennas are paired by placing them face-to-face, in the region of the slot, the ground planes merging into each other. By selecting certain parameters such as the widths $l_1$ and $l_2$, the longitudinal shift between elementary antennas, the position of the socket on the micro-strip line which feeds the two elementary antennas, and the width d of the non-conducting band separating the two elementary antennas, it is possible to obtain substantially any desired radiation diagram.

For all the above-described embodiments, the junction points between the micro-strip line and the edge of each semi-surface are preferably located at a distance substantially equal to $\lambda/4 \cos. \theta_o$ with respect to the first respective ends of the semi-surfaces.

According to a first preferred embodiment of the invention, the antenna is characterized in that the two metal-plated semi-surfaces are shifted longitudinally over a distance D less than or equal to $\lambda$ to produce between their free boundaries a geometrical shift of a predetermined value. The micro-strip line includes a longitudinal portion which extends across a length substantially equal to T at the centre of the band.

By taking two elementary antennas of equal or substantially equal widths and by adequately decentralizing the antenna socket on the longitudinal portion, it is possible to provide a variation of the first embodiment whereby the contact points between the microstrip line and the two semi-surfaces exhibit phase shift which is adequate to ensure the addition of the in-phase generated fields for the predetermined angle $\theta_o$ on either side of the band where the free boundaries of the two semi-surfaces face each other.

A second preferred embodiment in which there is substantially no longitudinal displacement between the two metal-plated semi-surfaces (the two elementary antennas), is characterized in that the micro-strip line extends substantially perpendicularly to the longitudinal band and has the socket connection point substantially in its centre. The said two halves of the metal-plated surfaces have widths $l_1$ and $l_2$ which are slightly different, and which vary along the antenna such that the exterior boundary of one semi-surface has a slightly convex shape while the other semi-surface has an exterior boundary of a slightly concave shape, so that the fields generated on either side of the band are in phase opposition near the first end of the antenna and in-phase at the centre of the antenna.

The field distribution in the meridian plane along such an antenna exhibits a cosinusoidal envelope which approximates a Gaussian law, for which the side lobes are theoretically non-existant. While indeed being present, the side lobes thus obtained are highly attenuated with respect to the major lobe.

A third embodiment is characterized in that the antenna according to the invention is a sectionalized antenna comprising a micro-strip line which extends perpendicularly to the longitudinal band and has the socket connection point substantially in its centre. The widths $l_1$ and $l_2$, respectively, of the semi-surfaces are constant, the dimensions $l_1$ and $l_2$ differing from each other by some percent.

A fourth embodiment of the directional antenna according to the invention for which a good roll diagram of a substantially cardioid shape is required, is characterized in that the band has a reduced width d on the order of twice the thickness e of the antenna.

BRIEF DESCRIPTION OF THE DRAWING

The following description which is given by of non-limitative example with reference to the accompanying figures will make it better understood how the invention can be put into effect.

DESCRIPTION OF THE PREFERRED EMBODIMENTS

Figure 1:
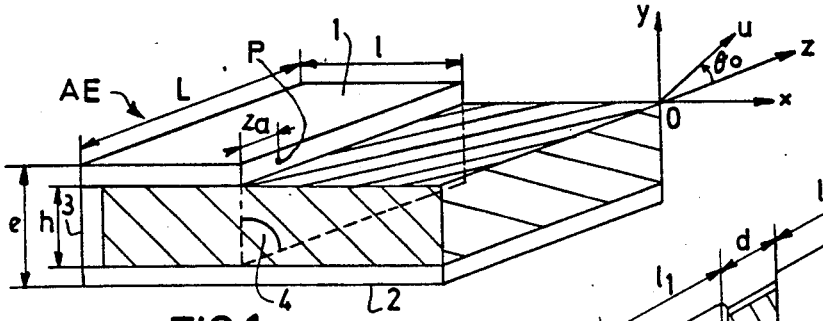
FIG. 1 shows an elementary antenna on which the construction of the antenna according to the invention is based.

The antenna AE shown in FIG. 1 is intended to transmit or receive very high frequency waves, of the order of several GHz (decimetric or centimetric waves). It is formed by two conducting planes 1 and 2 which constitute its largest faces, interconnected by an equally conducting perpendicular narrow wall 3, designated short-circuiting wall, which thus defines a zone 4 shown by means of broken lines, which zone is called a radiating slot. The space between the planes 1, 2 and 3 may contain air but is preferably filled with a dielectric material, as for example epoxy glass or teflon glass, whose thickness h is of the order of 1 mm for teflon glass and of several mm for epoxy glass. The antenna is fed at a point P of the face 1, which is called the feed face, the face 2 arranged oppositely thereto constituting the ground plane. This metal-plated ground plane comprises at least the rectangular portion arranged opposite to the face 1. To facilitate the description let it be assumed that the antenna is in the form of a rectangular parallelepiped containing the dielectric, having a length L, a width l and a thickness e (overall thickness), of which at least the two large faces ($L \times l$) and a face of the intermediate surface (L×e) are metal-plated, the small faces (l×e) being either plated or non-plated. Perpendicular coordinate axes $\overrightarrow{ox}$, $\overrightarrow{oy}$, $\overrightarrow{oz}$ are chosen such that the axis $\overrightarrow{oz}$ which is in parallel with the axis of the air-craft or the missile on which the antenna is mounted, extends in the direction of the length L of the antenna, the axis $\overrightarrow{ox}$ in the direction of the width l and the axis $\overrightarrow{oy}$ in the direction of the thickness e. The length L of the antenna is of the order of at least twice the wavelength λ of the wave one wants to transmit or to receive, and the width l is at least ten times less than L. For a thickness e as mentioned above, and with the feedpoint P being located near the slot and at a distance $z_a$ of a narrow wall of the order of $\lambda/4 \cos \theta_o$ it is found that the radiation diagram obtained is directional. That is the pitch diagram in the meridian plane yoz, exhibits a major lobe in a direction ou which is at an acute angle $\theta_o$ relative to the axis oz. The radiation diagram of the antenna has a semi-nappe shape for the major lobe and for each side lobe; it is symmetrical with respect to the meridian plane, and the roll diagram, considered on a cone having a centre O and an axis oz, takes the shape of a cardioid for any value of the angle $\theta$ when the antenna is flush-mounted along the meridian line of a revolving surface, that is to say the largest possible roll diagram obtainable. Such a diagram implies that the antenna operates in the resonant mode in the direction ox and in the controlled mode (travelling waves) in the direction $\overrightarrow{oz}$. In this type of antenna the electric field factor is at its maximum in the region of the slot 4 or, put more accurately, at some tens of millimeters beyond the slot and zero in the region of the short-circuited wall 3. The following simplified theory renders it possible to predict in a more or less correct way how the elementary antenna of FIG. 1 operates as a function of dimensional parameters, the frequency and the dielectric material used.

Figure 2:
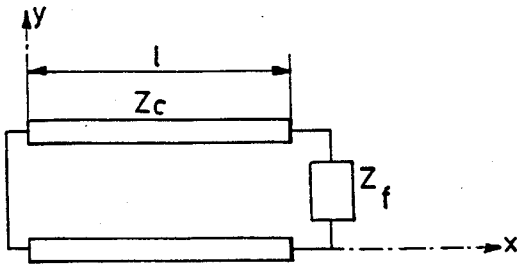
FIG. 2 is an equivalent circuit diagram of a cross-section of the elementary antenna.

The theory preferably used is that of the reduced transverse admittance as described in the publication "Waveguide Handbook", published by Mac Graw Hill in 1951, in the Radiations Laboratories Series, volume 10, chapters no. 4 and 6 in particular. Considering the elementary antenna of FIG. 1, the application of the transverse resonant principle results in the equivalent circuit diagram shown in FIG. 2 in which l denotes the width of the antenna, taken here as the length of the high frequency transverse line of the characteristic impedance $Z_c$, the vector of the wave (projected at ox): $k_x.\vec{x}$ and closed by the impedance $Z_f$, the latter taking account of all the exterior impedances at the antenna shown in plane 4 (FIG. 1), which plane will be called the radiating slot hereinafter. It can be written that:

$$\text{Cot}\,(k_x.l) = -j(Z_c/Z_f) \tag{1}$$

If it is assumed that $$Z_c/Z_f = G + jB \tag{2}$$

and $$k_x = a + jb \tag{3}$$

G, B, a and b being real numbers, the equation (1) can be written:

$$k_x = \frac{1}{2l} \text{arc tan}\left(\frac{2B}{G^2 + B^2 - 1}\right) + \tag{4}$$

-continued $$j\frac{1}{4l} \ln\left(\frac{(G+1)^2 + B^2}{(G-1)^2 + B^2}\right)$$

On the other hand, the propagation equation of the antenna is written:

$$k_x^2 + k_z^2 = \epsilon_r k^2 \tag{5}$$

where $$k_z = \beta_z - j\alpha_z \tag{6}$$

$\alpha_z$ designating the line attenuation along the axis oz, $$\beta_z = \frac{2\pi}{\lambda_g},$$

where $\lambda_g$ is the wavelength of the wave guided in the antenna along the axis oz, $$k = \frac{2\pi}{\lambda},$$

where λ is the wavelength in air, $\epsilon_r$ is the material with which the antenna is filled.

Let it further be assumed that:

$$k_x = \beta_x - j\alpha_x \tag{7}$$

$$k_x = \frac{2\pi}{\lambda_x} - j\alpha_x \tag{8}$$

where $\lambda_x$ is the wavelength of the wave guided along the axis ox.

By combining equations (4) and (8) (partially real) it is obtained that:

$$\lambda_x = \frac{4\pi l}{\text{arc } tg(2B/(G^2 + B^2 - 1)} \tag{9}$$

on the other hand, by combining equations (3), (5) and (6), it is obtained that:

$$\beta_z = \left(\frac{\epsilon_r k^2 + b^2 - a^2}{2}\left(\sqrt{1 + \left(\frac{2ab}{\epsilon_r k^2 + b^2 - a^2}\right)^2} + 1\right)\right)^{\frac{1}{2}} \tag{10}$$

and $$\alpha_z = \left(\frac{\epsilon_r k^2 + b^2 - a^2}{2}\left(\sqrt{1 + \left(\frac{2ab}{\epsilon_r k^2 + b^2 - a^2}\right)^2} - 1\right)\right)^{\frac{1}{2}} \tag{11}$$

At this stage of the calculations it is endeavoured to evaluate the parameters G and B of the type of antenna structure shown in FIG. 1. Let it be assumed that there are two parallel plane conductors spaced apart by 2 h. Referring to page 79 of the "Waveguide Handbook" already mentioned in the foregoing, and by using the theory of electric imaging, the admittance of the slot is, it being assumed that the dielectric stops at the plane 4 of the radiating slot:

$$G = \frac{\pi h}{2\lambda'}, \quad (12)$$

$$B = \frac{h \ln(e \cdot \lambda'/\gamma \cdot h)}{\lambda'} \quad (13)$$

where: e=2.718 (not to be mistaken for the overall thickness of the antenna which is not involved in the calculations).

$$\lambda = 1.781$$

$\lambda'$ being the wavelength of the wave guided in the plane xoy calculated in the air while, $\lambda_x$ is calculated in the dielectric.

$\lambda'$ can be determined from the propagation equations in the dielectric (formula (5)) and in the air, (formulae (5) and (8) in which $\lambda_y$ will be substituted for $\lambda_x$).

When all these calculations have been effected, then:

$$\lambda' = \frac{\lambda_x}{\sqrt{1 - (\epsilon_r - 1)(\lambda_x/\lambda)^2}} \quad (14)$$

It will be noted that, by definition, the angle $\theta_o$ of the direction of maximum radiation is related to $\lambda$, $\lambda_g$ and $\lambda'$ by the equations:

$$\cos \theta_o = \lambda/\lambda_g \quad (15)$$

$$\sin \theta_o = \lambda/\lambda' \quad (16)$$

The formulae (12) and (13) do not take account of the fact that the ground plane 2 of the antenna is covered with a dielectric material having a dielectric constant $\epsilon_r$ and a height h. To take into account the path through which the wave radiated by the plane 4 in this dielectric flows, it is assumed that the slot 4 is covered by a radome having a thickness $\bar{d}$ and a dielectric constant $\epsilon_r$. From this the line theory gives, for the case where: $\bar{d} << \lambda_x$:

$$B = \frac{h}{\lambda'} \ln \frac{e \cdot \lambda'}{\lambda \cdot h} + 2\pi \bar{d} \lambda_x \frac{(\epsilon_r - 1)}{\lambda^2} \quad (17)$$

where $\bar{d}$ represents the lenth of the average path through which the "randome" flows. $\bar{d}$ can be determined by means of the Descartes Law and from the curves shown at pages 344 and 348 of the "waveguide handbook"; when all the calculations have been effected it is obtained that:

$$\bar{d} = \frac{h}{\sqrt{\epsilon_r - 1}} (2/3 - 3/(400\sqrt{\epsilon_r - 1})) \quad (18)$$

which results particularly in:

$\bar{d}$=0.337 h for the epoxy glass ($\epsilon_r$=4.5)

$\bar{d}$=0.490 h for the teflon glass ($\epsilon_r$=2.55).

The expression of B then becomes:

$$B = \frac{h}{\lambda'} \ln \frac{e \cdot \lambda'}{\gamma \cdot h} + \frac{2\pi h \cdot \lambda_x}{\lambda^2} \sqrt{\epsilon_r - 1} (2/3 - 3/(400\sqrt{\epsilon_r - 1})) \quad (19)$$

The influence of the "randome" on G (formula (12)) is that it reduces the apparent height h in the formula (12). By using the electric imaging theory and associating the distribution of the roll energy and the apparent height $h_3$ it can be derived that the new value to be adopted for G is:

$$G = \frac{\tau_o H_3}{2\lambda'}$$

where $H_3$=h/2, or:

$$G = \frac{\pi h}{4\lambda'}$$

The antenna shown in FIG. 1 may inter alia, for diverse reasons, be coated with a dielectric film having a thickness h' and a dielectric constant $\epsilon'$. As in the foregoing the line theory results in a term of the shape:

$$\frac{2\pi h' \lambda_x(\epsilon' - 1)}{\lambda^2} \text{ for } h' << \lambda_x$$

being added to B.

The formulae which are ultimately retained for G and B are therefore:

$$G = \frac{\pi}{4\lambda'} \quad (21)$$

$$B = \frac{h}{\lambda'} \ln \frac{e \cdot \lambda'}{\gamma \cdot h} + \frac{2\pi\lambda_x}{\lambda^2} [h'(\epsilon' - 1) + h(2/3 - 3/(400\sqrt{\epsilon_r - 1}))\sqrt{\epsilon_r - 1}]$$

where $h << \lambda_x$ and $h' << \lambda_x$

By resolving the system constituted by the four equations (9), (14), (20) and (21) the values of G and B are obtained as a function of the antenna characteristics: h, h', $\epsilon_r$, $\epsilon'$, $\lambda$, l.

It will further be noted that a and b are expressed as functions of the quanties G and B (see formulae (3) and (4)). The values of $\alpha_z$ and $\beta_z$ (formulae (10) and (11)) can finally be obtained by means of the values of G and B and of a and b as functions of the six antenna characteristics indicated above.

In order to enable the determination of the antenna diagram it is furthermore necessary to integrate the ohmic and dielectric losses inherent to the materials used. These losses are given the reference $\alpha_{zo}$, the total attenuation in the direction oz being given the reference $\alpha_{zt}$ where $$\alpha_{zt} = \alpha_z + \alpha_{zo}$$

The ohmic losses denoted $\alpha_1$ can be calculated from the literal expression of the power conveyed between two transversal sections at a distance $\Delta_z$ from the antenna and by thereafter using the Maxwell equations for the modes TE.

The dielectric losses $\alpha_2$ are the result of the fact that the dielectric constant of a material is expressed by a complex number, namely:

$$\epsilon_r = \epsilon'_r - j\epsilon''_r$$

where $$\tan\delta = \frac{\epsilon''_r}{\epsilon'_r}$$

The line attenuation in the field of a travelling wave in such a medium is then expressed by:

$$\alpha_2 = \frac{\pi\sqrt{\epsilon_r}\tan\delta}{\lambda} \tag{22}$$

After all these calculations have been effected, it is finally obtained that:

$$\alpha_{zo} = \alpha_1 + \alpha_2$$

$$\alpha_{zo} = \frac{\pi\sqrt{\epsilon_r}\tan\delta}{\lambda} + 1{,}2\ 10^{-5}\sqrt{\frac{l\sqrt{\epsilon_r}}{h}}\ \lambda\lambda_g\frac{(h + l(3/4 + 4\epsilon_r l^2/\lambda^2))}{16l3h} \tag{23}$$

$\rho$ being the resistivity of the metal with which the antenna is coated, calculated with respect to the resistivity of the copper, $\lambda_g$ being substantially equal to:

$$\lambda_g = \frac{\lambda}{\sqrt{\epsilon_r - \left(\frac{\lambda}{4l}\right)^2}} \tag{24}$$

The above formulae apply to a cross-section through the elementary antenna shown in FIG. 1. It is tried to determine from this stage by means of calculation the diagram in the meridian plane of the antenna, that is to say the pitch diagram, the roll diagram itself being generally of an almost cardioid shape when the antenna is flush-mounted on a generating line of a cylinder.

The diagram in the meridian plane is obtained from the law of illumination of the radiated fields. In the antenna shown in FIG. 1 it is assumed, by way of generalization, that the width l varies as a function of z. From this fact it is obtained, that $\alpha_{zt}$ and $\beta_z$ vary as a function of z. When the radiating length of the antenna is denoted by N, it is possible to divide the l(z)-law in steps of the size p, such that N/p is an integer. Consequently the antenna can be illustrated by the following diagram:

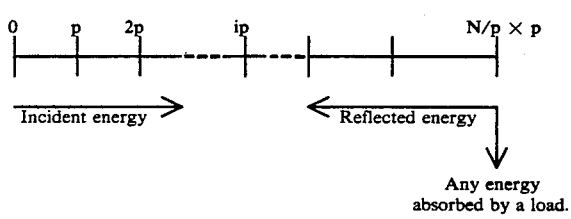

From the expressions for $\alpha_{zt}$ and $\beta_z$, it is possible to calculate the field for each cross section of the antenna (z=0, p, 2p, . . . , ip, . . . , p N/P), that is to say $$E(z = ip) = e^{Ai}\cos Bi + je^{Ai}\sin Bi - C[e^{A'i}\cos B'i + je^{A'i}\sin B'i] \tag{25}$$

the coefficient C which relates to the energy reflected from the ends of the antenna being such that:

$C^2=1$ when there is no matched load at the end of the antenna;

$C^2=0$ when there is an ideal matched load at the end of the antenna;

C being generally a complex number.

The coefficients Ai, A'i and Bi, B'i respectively can be expressed in known manner as a function of a limited partial addition to i of the terms of the sequence of the values of $\alpha_{zt}$ and $\beta_z$, respectively, as a function of i:

$$Ai = -p\left(\frac{\alpha_{zt}(z=0) + \alpha_{zt}(z=p)}{2} + \ldots + \frac{\alpha_{zt}(z=(i-1)p) + \alpha_{zt}(z=ip)}{2}\right)$$

$$Bi = -p\left(\frac{\beta_z(z=0) + \beta_z(z=p)}{2} + \ldots + \frac{\beta_z(z=(i-1)p) + \beta_z(z=ip)}{2}\right)$$

and $$A'_i = A_{N/p} - p\left(\frac{\alpha_{zt}(z=N) + \alpha_{zt}(z(N-1)p)}{2} + \ldots + \frac{\alpha_{zt}(z=(i+1)p) + \alpha_{zt}(z=ip)}{2}\right)$$

$$B'_i = B_{N/p} - p\left(\frac{\beta_z(z=N) + \beta_z(z=(N-1)p)}{2} + \ldots + \frac{\beta_z(z=(i+1)p) + \beta_z(z=ip)}{2}\right)$$

In order to understand the law of illumination of the radiated fields, it should be noted that between $z=ip$ and $z=(i+1)p$, the total line attenuation is:

$$\tfrac{1}{2}[\alpha_{zt}(z=ip)+\alpha_{zt}(z=(i+1)p)]$$

while the contribution to this attenuation by the radiation is:

$$\tfrac{1}{2}[\alpha_z(z=ip)+\alpha_z(z=(i+1)p)]$$

This means that the ratio at the point $z=ip$ between the radiated field and the field in the antenna is:

$$\alpha_z(z=ip/\alpha_{zt}(z=ip)$$

Hence, the law of illumination of the radiated fields:

$$E_R(z=ip) = \frac{\alpha_z(z=ip)}{\alpha_{zt}(z=ip)}E(z=ip) \tag{26}$$

The diagram is obtained by summation with respect to i:

$$\Gamma(\theta)' = \left| \sum_{i=0}^{i=N/p} E_R(z = ip)e^{j2\pi ip\cos\theta/\lambda} \right|^2 \sin\theta \quad (27)$$

where $\Gamma(\theta)$ represents the level of the radiated energy at a large distance in the direction $\theta$ (considered in the meridian plane yoz).

The multiple antennas according to the invention described in the foregoing, which are formed by two paired elementary antennas as shown in FIG. 1 have two independent or substantially independent illumination laws. To obtain the diagram of such an antenna, the pitch diagram in particular it is sufficient to add the field radiated along oz, to apply thereafter the formula (27) in the same way as it would be applied to the elementary antenna.

The antenna shown in FIG. 1 the width l of which will be constant along oz, will have an illumination law which is exponential as regards its amplitude and the first side lobe will be at only −7 dB below the major lobe. By having l vary as a function of z for this antenna, $\alpha_{zl}$ and $\beta_z$ are rendered variable as a function z. The variation of $\alpha_{zl}$ causes an amplitude fluctuation of the exponential law and the variation of $\beta_z$ creates a more significant fluctuation of the phase law. These two phenomena contribute towards widening of the major lobe, which is accompanied in known manner by a decrease of the side lobes. The largest decrease possible to obtain for the side lobes is approximately −11 dB below the major lobe. On the other hand the absence of the matched load at the end of the antenna may create a reflected wave whose phase and amplitude may modify by lowering it any side lobe but at the cost of the appearance of a back lobe, corresponding to the major lobe of the reflected energy. In addition, it is difficult to obtain a wide angle $\theta_o$, of approximately 70° with an elementary antenna. So the performance of the elementary antenna is limited and insufficient for the intended applications. On the other hand two of these antennas arranged pair-wise according to the invention as described above, render it possible to obtain very interesting radiation diagrams.

For all the embodiments of the above-described dual antenna, the anteanna is a body of a substantially rectangular parallelepiped shape having a thickness e, a length L and a width $l_t$ and, from the technological point of view, is formed by a substrate material having a dielectric constant $\epsilon_r$, for example epoxy glass or teflon glass, whose surface is almost entirely metal-plated. The radiating portion of the antenna, which is the only place where the internal dielectric material is in contact with the environment (the presence of any radome excepted) is reduced to a band of a fixed width d which extends over a large face of the parallelepiped in the longitudinal direction in such a manner that it divides this large face into substantially equal metal-plated semi-surfaces, the width d being of the order of several time the dimension e. The second large metal-plated face forms the ground plane of the antenna. In the region of their external boundaries the two large faces are interconnected by short circuits (metal plated walls or in-line plated-through holes). A micro-strip line which electrically crosses the band of the width d interconnects the semi-surfaces at points of their three boundaries near one metal-plated end of each of the semi-surfaces and comprises at a predetermined point the antenna socket. The thickness e is of the order of the thickness of a printed circuit board. The length L exceeds 2λ and, in a general way, is in such a ratio to the thickness e that the energy reflected at the remote end of the antenna is in substance so small as to be disregarded. The width $l_t$ of the antenna is between 0.02λ and 0.6λ. This general definition of all the embodiments described above gives details about the coupling of the two elementary antennas whose ground planes will merge into each other and whose respective planes are identical to the two metal-plated semi-surfaces of the dual antenna.

Figure 3:
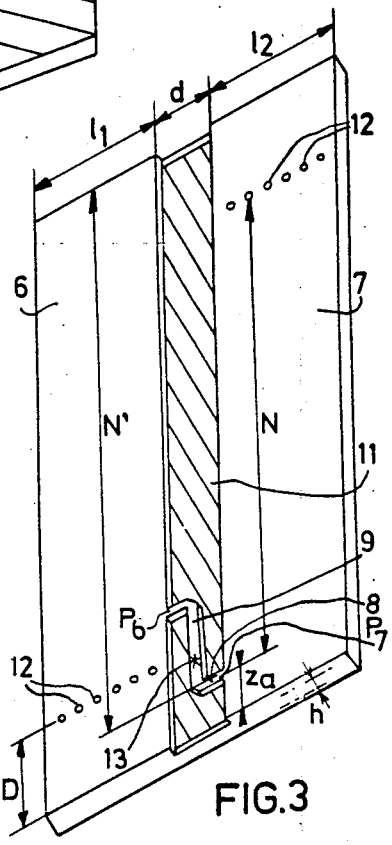
FIG. 3 show a first embodiment of the antenna according to the invention.

The dual antenna shown in FIG. 3 forms a first embodiment according to the invention and is obtained by combining two generally identical elementary antennas (identical at least as regards the law l(z)). In addition to the general definition given above, this antenna is characterized by a longitudinal shift of the two semi-surfaces 6,7 over a predetermined distance D, in that the dimension d is of the order of 6 to 8 times greater than the thickness e and that the microstrip line 8 exhibits a longitudinal portion which extends over a length substantially equal to D in the centre of the band 11 having a width d. It will be noted that the near feed end of the semi-surface 6 as well as the remote feed end of the semi-surface 7 are formed, in FIG. 3, by a linear arrangement of three through-plated holes, for example 12, which ensure a local contact of the two large faces, thus forming short circuits.

Figure 4:
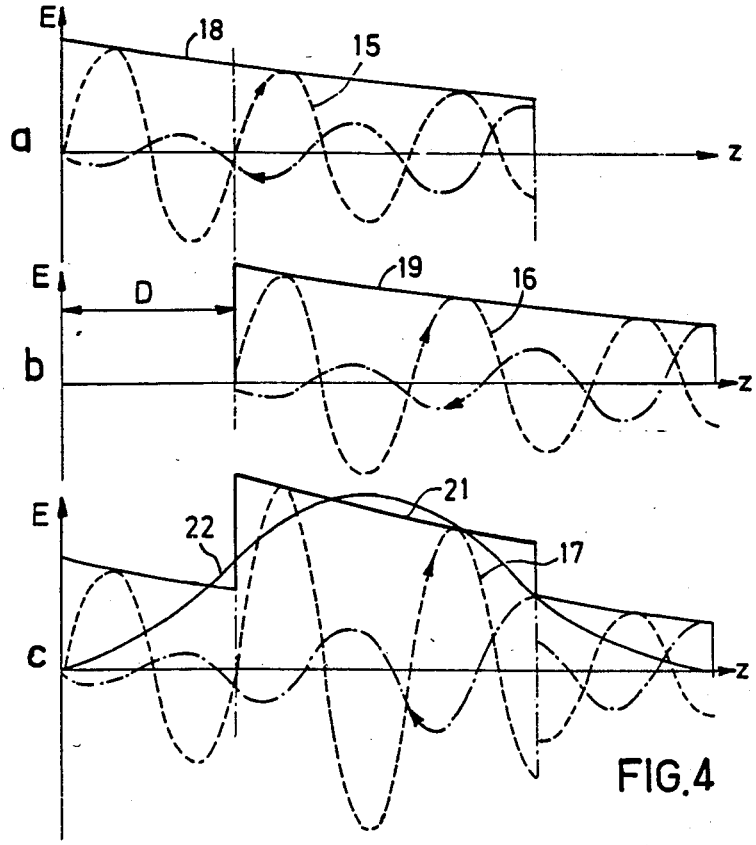
FIG. 4 shows the standard illumination law of the antenna shown in FIG. 3.

The diagram of the antenna shown in FIG. 3 can be formed by adding the in-phase fields in the desired main direction, and furthermore adding the anti-phase fields, in a direction one does not want to illuminate. This can be effected by acting on the parameter D and/or on the electric phase shift between the feed points $P_6$ and $P_7$ realised thanks to the choice of the position of the antenna socket on the micro-strip line, for example at a point 13. Nevertheless, the composition of the fields does not only involve the dimension D but also the dimension d which is the approximate distance separating the phase centres of each antenna. In comparison with the elementary antenna shown in FIG. 1, which has at least the advantage of an excellent roll diagram, the antenna of FIG. 3 has a reduced width of the roll diagram which is more significant as d is greater, and has a phase difference between the fields of the two semi-antennas which is more significant in the illuminated direction $\theta$. Whether the phase law is constant or not constant, along the antenna, the amplitude law has the general aspect of the diagram shown in FIG. 4. The field radiated by the semi-antenna (semi-surface) 7 is represented at a as a function of z, the field radiated by the semi-antenna (semi-surface) 6 is shown at b, and at c is shown the composite fields, that is to say the sum of these fields. Each broken-line curve 15, 16, 17 represents the amplitude of the incident field E(z) at a given instant, each dot-and-dash line represents the amplitude of the field reflected at the end of the antenna remote from the feed point, and each solid-line curve 18, 19, 21 represents the envelope of the incident field whose phase varies with time. The geometrical phase shift D is clearly shown in the Figure. If the antenna socket is located in the centre of the micro-strip line, the electric phase shift between the curves 15 and 16 will be equal to 180°. In FIG. 4 the instantaneous fields shown in 15 and 16 are in phase, which corresponds to an asymmetrical position of the socket on the micro-strip line 9 to ensure face opposition of the electric fields between the feed points $P_6$ and $P_7$ of the semi-antennas. Establishing any electric phase shift is within the grasp of a person skilled in the art and it will be noted that to obtain phase opposition between $P_6$ and $P_7$ two positions are possible for the socket on the micro-strip line. The result obtained (FIG. 4c) is the transmission of a field having an average value of the antenna and near the feed point, a high value in the middle of the antenna without marked discontinuities when passing through the short-circuited wall 12 near the feed point (FIG. 3) and a low value at the end remote from the feed point. The ideal amplitude law to reduce the side lobes to the largest possible extent results for the envelope of the radiated fields in a Gaussian curve as shown at 22 in FIG. 4c. This amplitude law easily results in −30 dB below the major lobe for all the side lobes. The curve 21, although it has rather marked discontinuities approximates the curve 22 better than the curves 18 or 19. In FIG. 4, the choice of the geometric and electric phase shifts of the antenna constitutes an optimisation in that sense that the geometric shift corresponds substantially to the wavelength of the field E(z) and that the electric phase shift antennuates to the largest possible extent the discontinuity in the fields when they pass through the short-circuit wall near the micro-strip line 8.

It will be noted that the discontinuities of the fields when they pass through the other short-circuited wall is more difficult to overcome but at the same time it is less important as the fields radiated there are weaker. The following digital application renders it possible to give more precise data of the performance of the antenna shown in FIG. 3. The antenna whose characteristics are described below has actually been produced and its radiation diagram has been measured, while its pitch diagram has also been calculated on the basis of the theory summarized above. A so-called associated antenna as shown in FIG. 3 has, for example, the following characteristics:

Nominal operating frequency: $F=3.1$ GHz
Geometrical shift: $D=60$ mm
Length of match: $z_a=\lambda_{go}/4=29$ mm
Spacing between semi-antennas: $d=10$ mm
Radiating length of each semi-antenna: $N=251$ mm
Radiating length: $N'=N+D=311$ mm, i.e. $3.3\lambda$
Overall width: $l_t=l_1+l_2+d=32$
Height of dielectric: $h=1.45$ mm
Dielectric constant: $\epsilon_r=4.5$ (epoxy glass)
Tangent of the loss angle: $\tan\delta=0.03$
Resistivity compared to copper: $\rho=3$
No natched loads: $C=1$
Electric phase shift: $\gamma d=172°$.

The radiating length being $3.3\lambda$, this antenna can be classified as a "short" antenna.

Figure 5:
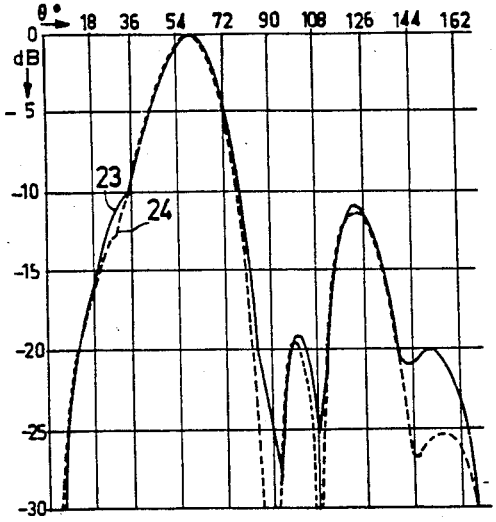
FIG. 5 is the radiation roll diagram of the antenna shown in FIG. 3.

The pitch diagram is shown in FIG. 5 in which the amplitude curve of the measured radiated fields is illustrated at 23 by means of a solid line and the amplitude curve of the calculated radiated fields is shown at 24 by means of a broken line, the ordinates being calculated in dB after standardization of the curves in such a way that their amplitude peaks match and the abscissas match in degrees, in accordance with the conventional Cartesian representation. For the diagram of FIG. 5 the operating frequency used for calculation purposes is 3.08 GHz and the experimental frequency has a value of 3.1 GHz. It can be seen that there is a rather good agreement between theory and experience. The angle $\theta_o$ is near 60° and the side lobes near 90° are lowered to −20 dB, the direction 90° thus forming a blind direction.

Figure 6:
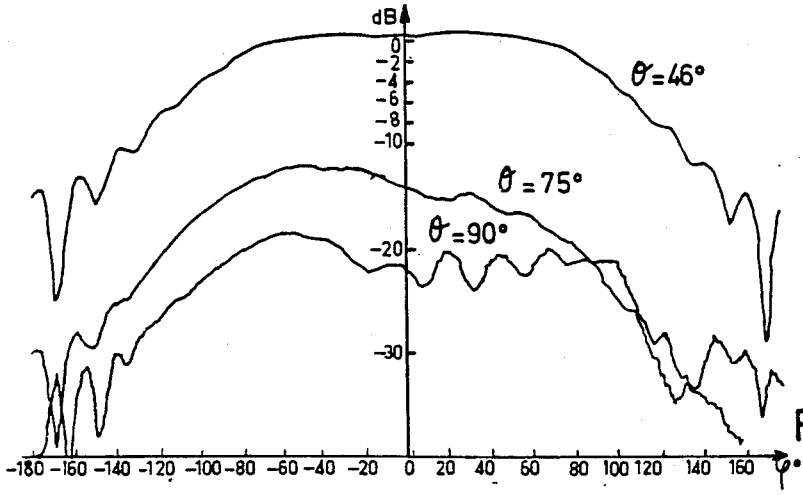
FIG. 6 is the radiation pitch diagram of the antenna shown in FIG. 3.

The roll diagram, FIG. 6, has been measured on the antenna whose characteristics are described above but for an operating frequency of 3.3 GHz. The manner of representation is the same as for the pitch diagram, the angle $\phi$ plotted on the abscissa being the angle at the centre of a central cone O and the axis oz, $\phi$ being zero (or equal to ±180°) in the meridian plane. As the frequency is 200 MHz higher compared to the corresponding frequency in FIG. 5, the corresponding pitch diagram, not shown, has a major lobe centred at $\theta_o=46°$, that is to say 14° less than in the foregoing, and always a blind direction for $\theta=90°$. The roll diagram shown in FIG. 6 has been measured for three values of $\theta$ shown here by way of parameters. A very wide diagram in the form of a cardioid in the main direction is shown ($\theta=46°$). In the blind direction ($\theta=90°$) the roll diagrams significantly deviates from the cardioid shape, which is not a drawback. It can be seen in this connection that the roll diagram of an elementary antenna shown in FIG. 1 assumes the shape of a cadioid for all the values of $\theta$.

The standing wave ratio (SWR) of this antenna can be made excellent, the micro-strip line 8 being provided with two impedance-matching transformers (not shown) feeding 50Ω back to the transition. The measured standing wave ratio is as follows:

SWR of −10 dB on a band of 450 MHz (i.e. approximately 15 %)
SWR of −15 dB on a band of 200 MHz (i.e. approximately 7%).

It will be clear that the SWR of all the antennas described in this application can be improved, if necessary, by an adequate choice of the dielectric material used and of its thickness, in combination with the intended operating frequency. The matching problem is made easier for the associated antenna because of the fact that the dimension d is comparatively large and that, consequently, the centre portion 9 of the micro-strip line which extends in the longitudinal direction does not disturb the field transmitted by each semi-antenna, which makes it possible to position the transition (points $P_6$, $P_7$) in any point of the free boundary of each semi-antenna 6, 7. It is also possible to provide associated antennas for which the width of the semi-surfaces 6 and 7 vary as a function of z, while maintaining identical elementary antennas. The antenna shown in FIG. 3 is used in the event of a short antenna ($N'<5\lambda$), which results in the radiation characteristics described above. In contrast therewith, when the available length is greater, two elementary antennas arranged to form an array as is shown in FIG. 7, are preferably used.

Figure 7:
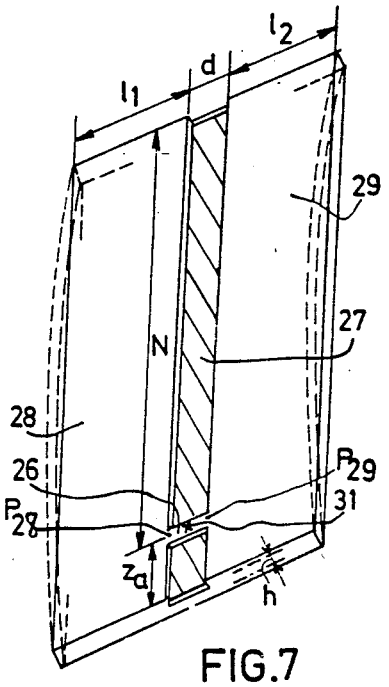
FIG. 7 shows by means of broken lines a second embodiment and, by means of solid lines a third embodiment of the antenna according to the invention.

The antennas shown in FIG. 7 are second and third embodiments according to the invention. In addition to the general above-described definition just preceding the description of the FIGS. 3 and 6, this antenna is characterized by the fact that the micro-strip line 26 extends in substance perpendicularly to the band 27, which has a width d and which separates the two semi-surfaces 28 and 29 and also in that these two metal-plated semi-surfaces 28 and 29 have slightly different widths $l_1$ and $l_2$ which puts this dual antenna in the class of complementary antennas, it being possible to vary their widths as a function of z as will be described hereinafter.

The antenna socket is generally located at the centre of the micro-strip line, in point 31. These characteristics which differ from those of the antenna shown in FIG. 3 result in different radiation properties.

Figure 8:
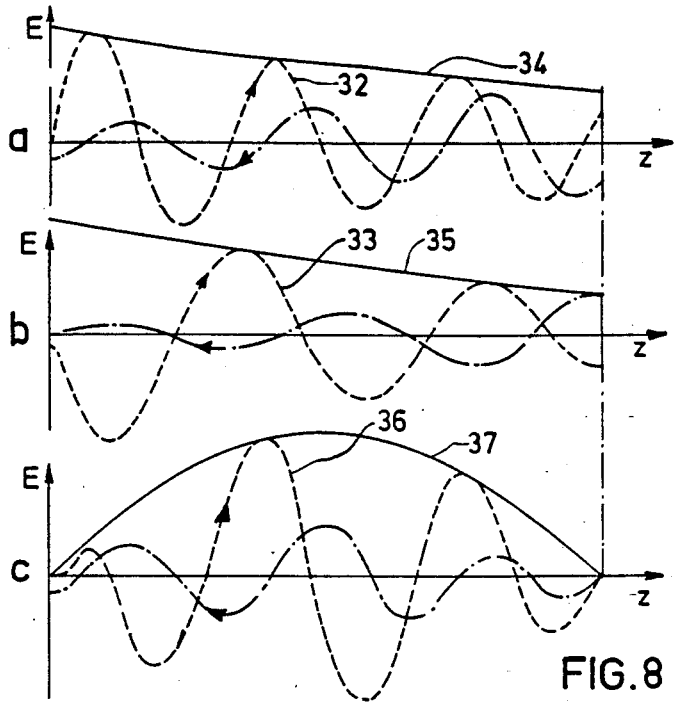
FIG. 8 shows the standard illumination law of the antenna shown in FIG. 7.

The amplitude law of the complementary antenna has the general aspect of the diagram of FIG. 8, where the same type of representation has been chosen as in FIG. 4. At a and b the instantaneous fields transmitted by each elementary antenna 28, 29 are represented by the respective broken lines 32, 33, the envelope of these fields, shown by means of a solid line, having been given the reference numerals 34, 35. The dot-and-dash line curves indicate the fields reflected from the ends of the antenna remote from the feed point in the absence of a matched load. FIG. 8c shows the sum of the curves of FIGS. 8a and 8b. Given the fact that there is coincidence on the axis ox from the beginning of the radiation portion of each semi-antenna and the fact that the antenna socket is in the centre of the micro-strip line, the fields transmitted very near the points $P_{28}$ and $P_{29}$ are in phase opposition and cancel each other. On the other hand, the length of the waves guided in the longitudinal direction are different for the two semi-antennas because of the different width of these antennas. This results in a progressive phase shift between the fields transmitted along the band 27 up to the point where phase agreement is obtained, preferably near the centre of the antenna, which results in a maximum ensuing field. Progressing still further towards the other end of the antenna, the radiated fields are again in phase opposition and, moreover, their respective amplitudes decrease. This results in (FIG. 8c) the broken line curve 36 for the resultant instantaneous field and for the envelope curve of the resultant fields in the solid-line curves 37 which more specifically approach the theoretical gaussian curve 22 in FIG. 4. The theory and practice perfectly confirm this mode of operation of the antenna, which is illustrated by the two pitch diagrams of FIGS. 9 and 10 obtained for the variants of the complementary antenna of FIG. 7.

A first variant (second embodiment) consists in curving the short-circuited lateral walls of the two semi-antenna slightly inwardly, which amounts to rendering the widths $l_1$ and $l_2$ variable as a function of z. These lateral walls are, for example, curved as indicated by a broken line, one wall being convex ($l_1$ widens towards the centre of the antenna) while the other one is concave ($l_2$ narrows towards the centre of the antenna).

A complementary antenna in accordance with this first variant has, for example, the following characteristics:

Nominal operating frequency: F=5.9 GHz
Length of match: $za=\lambda_{go}/4=15$ mm
Distance between semi-antennae: d=6 mm
Radiation length: N=315 mm, i.e. 6.25λ
Overal width: $l_t=l_1+l_2+d=21.4$
Height of dielectric material: h=0.78 mm
Dielectric constant: $\epsilon_r=2.55$ (teflon glass)
Tangent of the loss angle: tan δ=0.0002
Resistivity compared to copper: 1 =3
No matched loads: C=1
Total phase shift: 170°

The law giving $l_1$ and $l_2$ as a function of z for the two semi-antennas (in mm):

| z | 0 | 75 | 135 | 195 | 215 | 255 | 295 | 315 |
|---|---|---|---|---|---|---|---|---|
| $l_1$ | 7,7 | 7,75 | 7,8 | 7,85 | 7,85 | 7,8 | 7,75 | 7,7 |
| $l_2$ | 7,65 | 7,6 | 7,55 | 7,5 | 7,5 | 7,55 | 7,6 | 7,65 |

Figure 11:
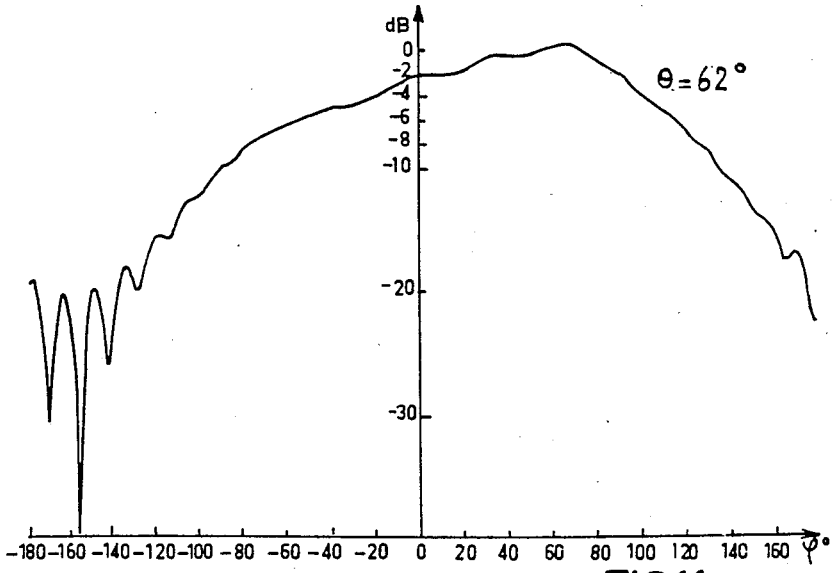
FIG. 11 is the radiation roll diagram of the antenna shown in FIG. 7.

Disregarding the matching problems of the two semi-antennas, which problems will be described hereinafter, the radiation diagrams are those shown in FIG. 9 for the pitch diagram and in FIG. 11 for the roll diagram in which the same mode of representation has been adopted as for the respective FIGS. 5 and 6. The pitch diagram has a maximum gain angle $\theta_o=62°$ and side lobes reduced to below −15 dB, the weakest side lobes being obtained for: $\theta<\theta_o$. The roll diagram, FIG. 11, is only plotted for the main direction of radiation, that is to say $\theta=\theta_o=62°$. Given the illumination principle chosen, which implies phase shifts between the fields transmitted by the two semi-antennae (see FIG. 8) and the fact that the value of d is rather high and must not be disregarded compared with the wavelength λ, this roll diagram is narrower, that is to say it is worse than the diagram of the cardioid shape. This circumstance leads to the choice, for the calculations, of a quantity G which is slightly less than the quantity indicated by the following formula 20, i.e.:

$$G=\frac{\pi h}{5\lambda'} \tag{28}$$

Figure 9:
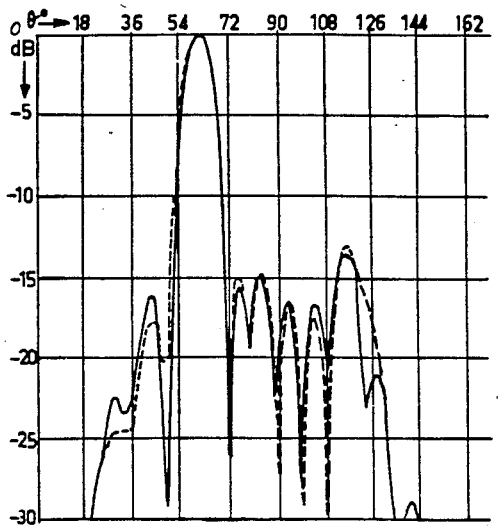
FIG. 9 is the radiation pitch diagram of the second embodiment of the antenna.

Adapting the antanna in accordance with FIGS. 9 and 11 can be realized in such a way that:

$Z_c=40.6\Omega$

In these circumstances, the SWR obtained, without matched loads is as follows:

SWR of −25 dB over a band of 100 MHz (1.7%)
SWR of −19 dB over a band of 400 MHz (6.5%)
SWR of −13 dB over a band of 700 MHz (11.5%)
SWR of −10 dB over a band of 900 MHz (15%).

This excellent SWR is considerably better than the SWR generally required, typically equal to −10 dB over a band of 100 MHz.

In accordance with a second variant of the antenna of FIG. 7 (third embodiment) the widths $l_1$ and $l_2$ of the semi-antennae are fixed but differ slightly from each other, which constitutes a third embodiment according to the invention. A complementary antenna in accordance with said second variant has, for example, characteristics which are identical to those described in the preceding paragraphs, their widths excepted, which are here:

$l_1=7.8$ mm $l_2=7.5$ mm

Figure 10:
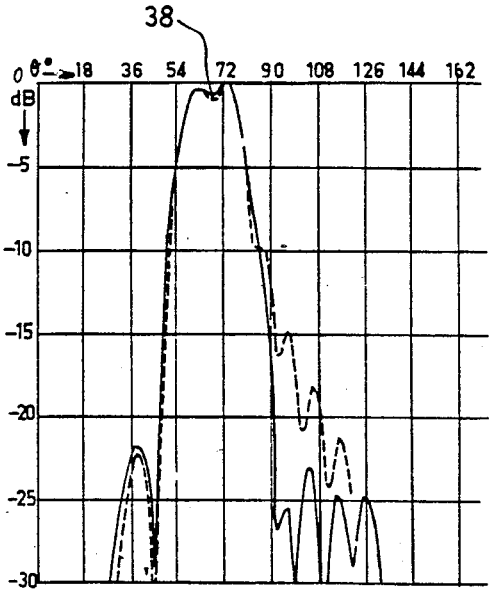
FIG. 10 is the radiation pitch diagram of the third embodiment of the antenna.

FIG. 10 shows by means of a broken line the theoretical pitch diagam and by means of a solid line the pitch diagram measured for the same frequency of 5.9 GHz as in FIG. 9. These diagrams have very weak side lobes (less than −20 dB). The major lobe obtained for $\theta_o=66°$ is significantly wider than in FIG. 9, which renders this antenna a very attractive sectorial antenna for certain applications in the field of radar, the more so since it is not so bulky and is of an extremely simple construction. It will be noted that the major lobe is formed from two juxtaposed lobes having substantially the same amplitudes, which explains the slight fold 38 which is observed at the peak of the curve. If, taking the diagram of FIG. 10 as the starting point, the operating frequency is progressively increased, to the order of 100 to 200 MHz, a simultaneous shift towards the left of the peaks of these lobes can be seen, these lobes tending to appproach each other until the fold 38 disappears. Conversely, a progressive reduction of the order of 100 to 200 MHz will cause a simultaneous shift towards the right of the peaks of the two lobes which will then tend to move away from each other, the fold 38 then becoming increasingly larger. For the sectorial complementary antenna, the roll diagram is substantially the diagram shown in FIG. 11 and the description of that Figure given above remain valid, it also here being necessary to take a value of: $\pi h/5\lambda'$ for the value G.

Matching the antenna can be effected in the same as for the curved complementary antenna, with comparable performances (see the examples given here below, specifically with reference to FIG. 4).

Figure 12:
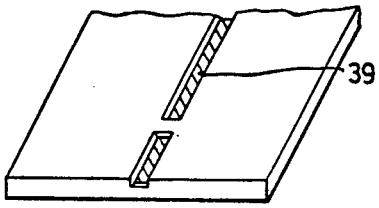
FIG. 12 shows a fourth embodiment of the antenna according to the invention.
Figure 13:
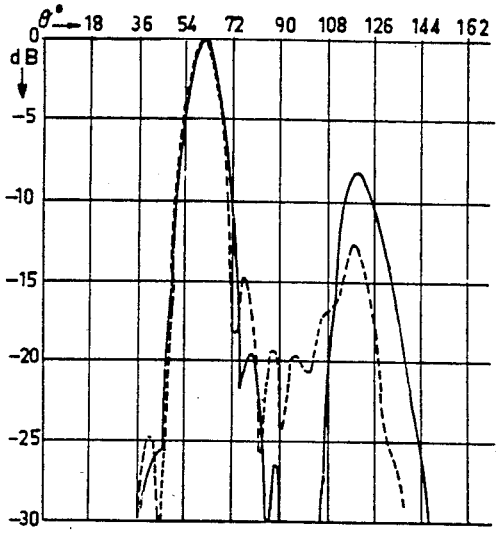
FIG. 13 is the radiation pitch diagram of the antenna shown in FIG. 12.

Taking the complementary antenna shown in FIG. 7 as the starting point, a possibility to improve the roll diagram with respect to the roll diagram of FIG. 11 consists in reducing the dimension d until the active radiating portions (phase centres) located somewhat beyond the slot for each semi-antenna, are practically contacting each other, for which reason this fourth embodiment of the antenna according to the invention, illustrated in the FIGS. 12 and 13 is designated a contiguous slot antenna. The maximum closeness which seems possible for the operating frequencies of some GHz used is of the order of 2 h. FIG. 12 shows, partially, a contiguous-slot antenna whose characteristics, disregarding the reduction in the width of the band 39, are the same as those of the complementary antenna shown in FIG. 7.

The antenna with the following characteristics has, for example, been calculated, realised and experimented with:

Nominal operating frequency: F=7.9 GHz
Length of match: $z_a$=12 mm
Distance between semi-antenna: d=2 mm
Radiation length: N=234 mm i.e. 6.2λ
Overall width: $l_t \simeq 15$ mm
Height of dielectric material: h=0.78 mm
Dielectric constant: $\epsilon_r$=2.55
Tangent of the loss angle: tan δ=0.0002
Resistivity compared to copper: 1 =3
No matched load: C=1.

The quantity G is not corrected in this case and remains in accordance with formula 20 as the roll diagram obtained is substantially a cardioid.

The law giving $l_1$ and $l_2$ as a function of z is:

| z | 0 | 150 | 234 |
|---|---|---|---|
| $l_1$ | 5,6 | 5,6 | 5,6 |
| $l_2$ | 5,65 | 5,75 | 5,65 |

The calculated pitch diagrams (broken line) and the measured pitch diagram (solid line) are shown in FIG. 13. The angle $\theta_o$ is equal to 62°. The side lobes are highly attenuated (less than −20 dB) for $\theta < \theta_o$ and for $\theta$ near 90° (the angle for which there is a blind direction). As regards these two curves, a strong back lobe is present for which there are significant differences in form and amplitude. The peak of this back lobe is located in both cases at the abscissa $\theta = 180 - 62 = 118°$. This consequently relates to a major lobe of the radiation reflected by that end of the antenna which is remote from the feed point. It is possible to considerably attenuate this back lobe by placing one (the) matched charge(s) at this end of the antenna or by extending the latter. The agreement between the two curves of FIG. 13 is, generally speaking, less marked than in the preceding cases (FIGS. 5, 9 and 10) especially as regards the number and shape of the secondary lobes, which means that the antenna of FIG. 12 has a mode of operation which is more difficult to predict then for the preceding antennas based on the above-described theory. This fact can probably be explained in that the two semi-antennae are very near to each other, that the transmitted radiations interfere with each other in such a manner as to create a supplementary parasitic mode and that the theory in question is not sufficient to wholly explain in itself the real measured radiation diagrams. For an operating frequency of 7.7 GHz for the antenna shown in FIG. 12, the number of side lobes is reduced compared to the FIG. 13 (the strong back lobe always being present) and the angle $\theta_o$ is located at 72°. For 8.2 GHz, the number of back lobes is increased with always a strong back lobe at approximately −8 dB relative to the major lobe and the angle $\theta_o$ is situated at 52°.

In the foregoing the problem of matching the antenna has been ignored, for simplicity of the description. A person skilled in the art will generally know how to solve this problem which, without being very important, may yet be the principal cause of a poor operation of the antenna, when it is neglected or poorly solved. Hereinafter with reference to FIG. 14 a possible solution for a better matching of the complementary antenna according to the invention in particular will be described.

The characteristic impedance of a rectangular waveguide having a height h and a width 2l, filled with a dielectric having a dielectric constant $\epsilon_r$ is given in the literature by:

$$Z_c = \frac{240\pi\lambda_g \cdot h}{(2\sqrt{\epsilon_r}\,\lambda \cdot l)} \tag{29}$$

the impedance $Z_c$ being measured in the centre between the side walls of the guide, at the intersection of a meridian plane and a transversal plane. An elementary antenna comparable to the antenna shown in FIG. 1 is such that the distribution of the magnitic and electric fields in the elementary antenna is the same as that of one side of the waveguide. The characteristic impedance of an elementary antenna is therefore such that placed in parallel with itself, $Z_c$ is found, that is to say:

$$Z_{c(AE)} = 2\,Z_c = \frac{240\pi\lambda_g \cdot h}{\sqrt{\epsilon_r}\,\lambda \cdot l} \tag{30}$$

It is therefore sufficient to ensure that the transition micro-strip line-elementary antenna is good, that the characteristic impedance of the line transmitting the energy to the antenna is equal to $Z_{c(AE)}$. In addition, the antenna must be infinite, the transition must be located at a distance $$(2n+1)\frac{\lambda g}{4},$$

(where n is a positive integer) from the entire short circuit, except when n is sufficiently high so that the level of reflected radiation is so low as to be disregarded, which is generally the case for the antenna according to the invention. It should be noted that in the case of complementary antennas the characteristic impedances of the two elementary antennas are in parallel and consequently lead to the impedance $Z_c$. On the other hand, when for any geometrical reasons an elementary antenna is such that at the abscissa $z=ip$ it is not possible to have propagration there, the energy then returns to the transition, which creates for this antenna a SWR which is poorer than for the other elementary antenna. This results in that the first elementary antenna receives less energy. This remark is important for it indicates that when the illuminations of the elementary antennas are added together it is in fact necessary to weight each illumination by the SWR of each elementary antenna under consideration.

Figure 14:
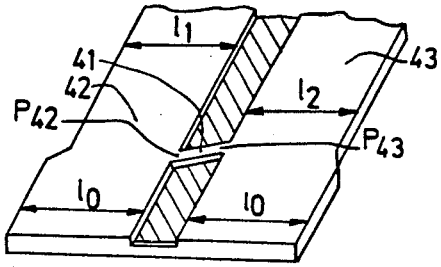
FIG. 14 is an arrangement to control matching of each semi-surface to the common antenna socket.

In the case of complementary antennas, if they are not matched to 50 Ohms, it may prove to be necessary to create an asymmetry in the region of the supply as described herebelow with reference to FIG. 14 in which only the fed stub portion of the antenna is shown.

As regards its radiating portion, the antenna of FIG. 14 is comparable to the antenna of FIG. 7. In contrast therewith, the remaining portion differs in that the micro-strip line 41 crosses the band of the width d with a slight slope so that it emerges in the feed point $P_{42}$ relative to the semi-surface 42 in an intentionally widened portion of the feed end of the antenna (width $l_o$ such that $l_o>l_1>l_2$) while the opposite point $P_{43}$ emerges in the non-widened radiating portion of the elementary antenna facing it. The widening operation to $l_o$ on either side of the feed end of the antenna is accompanied by a shortening of this end of the same order of magnitude. Thus a controllable resonant cavity effect is obtained for the semi-surface 42, which makes is possible to optimize the total match of the complementary antenna. The longitudinal shift between the feed points $P_{42}$ and $P_{43}$ implies a slight geometrical shift (as is the case for the associated antenna of FIG. 3 where this phase shift is desired). Here it concerns a parasitic shift which can be compensated for by an electric shift of the same amplitude and of the opposite sense obtained thanks to a small adequate decentring of the antenna socket on the micro-strip line 41. By means of the arrangement shown in FIG. 14 it is also possible to widen the matching band of the relevant antenna.

In practice the digital applications described above for the complementary antenna (sectionalized or non-sectionalized) have been effected by using the arrangement of FIG. 14 and this special mode of matching results in the radiation diagrams of FIGS. 9, 10 and 11, taking the value 9 mm for $l_o$ and the value 1 mm for the longitudinal shift between the feed points $P_{28}$ and $P_{29}$, the location of the socket then not being at 31 anymore as shown in FIG. 7, but slightly shifted therefrom.

In these circumstances, the matches are as follows: for the second and third embodiments, i.e. the complementary non-sectionalized antenna and the complementary sectionalized antenna of FIGS. 9 to 11, the characteristic impedance of the semi-antenna 28 is near 55Ω, with $l_o$. The characteristic impedance of the semi-antenna 29 is 155Ω for the complementary, non-sectionalized antenna and 140Ω for the complementary, sectionalized antenna (with $l_2$). For the non-sectionalized antenna the energy distribution is then theoretically of the order of $\frac{3}{4}$ for the elementary antenna having the width $l_1$ and $\frac{1}{4}$ for the elementary antenna of the width $l_2$, that is to say a relative voltage level of 58% between the two elementary antennas. In practice the relative voltage level obtained (diagram of FIG. 9), is not 58% but 38%.

The SWR obtained for this antenna, described above is of the same order as a theoretical SWR of −20 dB obtained for a total impedance of the antenna of:

$$Z_c=(1/55+1/155)^{-1}=40.6\Omega$$

For the sectionalized antenna, the energy distribution is 28% for the elementary antenna of the width $l_1$ and 72% for the other elementary antenna, that is to say a theoretical relative voltage level of 62% between the two elementary antennae. The actual relative voltage level obtained (see diagram FIG. 10) is 60%.

There are still further known methods of matching antennas, which methods are within the grasp of a person skilled in the art and which are compatible with the antennas according to the invention, such as, for example, converting the feed end of the antenna into a resonant cavity which may be an interesting solution for the continuous-slot antenna. In the same order of ideas, when it is established that some antenna or other evidences a level which is too high for the back side lobes, that is to say resulting from the energy reflected at the ends of the antenna remote from the feed point, it is always possible to eliminate in substance this reflected radiation by applying matched loads to this last-mentioned end. It will furthermore be noted that when the roll diagram has a shape very near the shape of a cardioid, two antennas according to the invention provided on diametrically opposite generating lines of the cylinder constituting the missile, for example, are sufficient to obtain the ideal circular roll diagram.

When the roll diagram of the antenna deviates from the cardioid shape, that is to say it becomes less wide, it is necessary, when a complete 360° angular envelope is desired to arrange a number equal to or more than 3 antennas equidistantly in angular positions relative to each other around the device on which they are mounted.

What is claimed is:

1. A directional antenna having a radiation angle $\theta_0$ formed by a body having a parallelepiped shape, said body comprising:

(a) a dielectric sheet of thickness h;

(b) electrically-connected conductive plating on opposite sides and edges of the dielectric sheet, the plating on one side forming a ground plane and the plating on the opposite side forming first and second conductive surfaces of widths $l_1$ and $l_2$, respectively, separated by a longitudinally extending gap of width d, said gap exposing a band of the dielectric sheet; and (c) a conductive strip extending across the gap and electrically connecting the first and second conductive surfaces at respective feedpoints near a first end of the gap, said conductive strip containing a feedpoint for the antenna at a predetermined location therein; and where:

(1) said dielectric sheet and the first and second conductive surfaces have a combined thickness e, said width d being several times the thickness e;

(2) each of said first and second conductive surfaces has a length L, measured along the gap, over which said conductive surface is conductively isolated from the ground plane, said length L being greater than twice the operational wavelength λ of the antenna;

(3) the width d has a value between 0.2λ and 0.6λ; and (4) the widths $l_1$ and $l_2$ sum to a total width $l_t$ having a value between 0.2λ and 0.6λ.

2. A directional antenna as in claim 1 where the feedpoints of the first and second conductive surfaces are at a distance $\lambda/4 \cos \theta_0$ with respect to a first end of each of the first and second conductive surfaces.

3. A directional antenna as in claim 1 or 2 where the respective lengths L of the first and second conductive surfaces are shifted longitudinally with respect to each other by a distance D which is less than or equal to λ, said conductive strip having a longitudinally extending portion of length substantially equal to D.

4. A directional antenna as in claim 3 where the widths $l_1$ and $l_2$ are substantially equal, and where the antenna feedpoint is located on the conductive strip at a point in the longitudinally extending portion which will effect in-phase summing of waves at the feedpoints of the first and second conductive surfaces.

5. A directional antenna as in claim 1 or 2 where the conductive strip extends perpendicularly to the direction of the longitudinally extending gap, and where the widths $l_1$ and $l_2$ differ slightly and vary along the lengths of the respective first and second conductive surfaces such that an outer edge of one of said conductive surfaces has a convex shape while the corresponding outer edge of the other conductive surface has a concave shape, thereby causing fields generated on either side of the band to be substantially in phase opposition near a first end of the antenna and are in phase at the center of the antenna.

6. A directional antenna as in claim 1 or 2 where the conductive strip extends perpendicularly with respect to the longitudinal gap, where the antenna feedpoint is located in the conductive strip substantially at the center of the gap, and where the widths $l_1$ and $l_2$ are substantially constant along the length of the gap and differ from each other by several percent.

7. A directional antenna as in claim 1 or 2 where the width d is approximately equal to twice the thickness e.

8. A directional antenna as in claim 1 or 2 where the first and second conductive surfaces, along their lengths between a first end of the antenna and their respective feedpoints, each have a width $l_0$ which is slightly larger than their respective widths along the remaining length of the antenna.

9. A directional antenna as in claim 1 or 2 where the dielectric sheet consists essentially of epoxy glass.

10. A directional antenna as in claim 1 or 2 where the dielectric sheet consists essentially of teflon glass.

* * * * *

UNITED STATES PATENT AND TRADEMARK OFFICE

CERTIFICATE OF CORRECTION

PATENT NO. : 4,591,865

DATED : May 27, 1986

INVENTOR(S) : YVES STEPHANE CANAL

It is certified that error appears in the above-identified patent and that said Letters Patent is hereby corrected as shown below:

IN THE CLAIMS

Claim 5, column 21, line 24, after "gap," insert

--where the antenna feedpoint is centrally located with respect to the gap,--.

Signed and Sealed this

Twenty-third Day of December, 1986

*Attest:*

DONALD J. QUIGG

*Attesting Officer* *Commissioner of Patents and Trademarks*